US009932788B2

(12) United States Patent
White et al.

(10) Patent No.: US 9,932,788 B2
(45) Date of Patent: Apr. 3, 2018

(54) OFF BOTTOM FLOW DIVERTER SUB

(71) Applicant: ATLAS COPCO SECOROC LLC, Grand Prairie, TX (US)

(72) Inventors: Michael A. White, Roanoke, VA (US); Jeffrey P. White, Vinton, VA (US)

(73) Assignee: Epiroc Drilling Tools LLC, Fort Loudon, PA (US)

( * ) Notice: Subject to any disclaimer, the term of this patent is extended or adjusted under 35 U.S.C. 154(b) by 324 days.

(21) Appl. No.: 14/596,469

(22) Filed: Jan. 14, 2015

(65) Prior Publication Data

US 2016/0201413 A1 Jul. 14, 2016

(51) Int. Cl.

| | |
|---|---|
| ***E21B 21/10*** | (2006.01) |
| ***E21B 23/00*** | (2006.01) |
| ***E21B 4/02*** | (2006.01) |

(52) U.S. Cl.

CPC ..... *E21B 21/103* (2013.01); *E21B 4/02* (2013.01); *E21B 23/006* (2013.01)

(58) Field of Classification Search

CPC ... E21B 23/00; E21B 4/02; E21B 4/00; E21B 21/10; E21B 21/00; E21B 21/103; E21B 23/996; E21B 21/12; E21B 10/04

See application file for complete search history.

(56) References Cited

U.S. PATENT DOCUMENTS

| | | | | |
|---|---|---|---|---|
| 2,865,602 A | | 12/1958 | Frank | |
| 3,334,697 A | | 8/1967 | Edwards | |
| 4,019,592 A | | 4/1977 | Fox | |
| 4,240,652 A | | 12/1980 | Wong et al. | |
| 4,295,524 A | * | 10/1981 | Baker | E21B 43/045 166/127 |
| 4,298,077 A | | 11/1981 | Emery | |

(Continued)

FOREIGN PATENT DOCUMENTS

| | | |
|---|---|---|
| CA | 2328636 A1 | 7/2002 |
| CN | 2539832 Y | 5/2003 |

(Continued)

OTHER PUBLICATIONS

Chinese Patent Office Notification of First Office Action (With English Translation)—Apr. 7, 2015 (Issued in Counterpart Application No. CN 201280044345.6).

*Primary Examiner* — Yong-Suk Ro

(74) *Attorney, Agent, or Firm* — Venable LLP; Jeffri A. Kaminski

(57) ABSTRACT

An off bottom flow diverter subassembly. A fronthead and shank each includes a central bore. One of the shank and the fronthead has an outer diameter configured to fit within the central bore of another of the fronthead and shank. The shank and fronthead are arranged to slide longitudinally with respect to each other and are limited from sliding out of contact with each other. At least one diverting flow passage is between adjacent sliding surfaces of the shank and fronthead. Sliding the fronthead and shank with respect to each other opens and closes the diverting flow passage. Application of a force, sufficient to open the diverting flow passage, to a drill string to which the subassembly is attached in a direction toward an opening of a hole being drilled causes the diverting flow passage to open and drilling fluid to flow out of the subassembly away from the bit.

18 Claims, 12 Drawing Sheets

(56) References Cited

U.S. PATENT DOCUMENTS

| | | | | |
|---|---|---|---|---|
| 4,445,265 | A | 5/1984 | Olson et al. | |
| 4,630,691 | A | 12/1986 | Hooper | |
| 5,085,284 | A | 2/1992 | Fu | |
| 5,174,392 | A * | 12/1992 | Reinhardt | E21B 4/02 175/107 |
| 5,407,020 | A | 4/1995 | Beavers | |
| 5,417,281 | A | 5/1995 | Wood et al. | |
| 5,682,957 | A | 11/1997 | Lyon | |
| 5,996,712 | A | 12/1999 | Boyd | |
| 6,202,762 | B1 | 3/2001 | Fehr et al. | |
| 6,305,723 | B1 | 10/2001 | Schutz et al. | |
| 6,863,137 | B2 | 3/2005 | Terry et al. | |
| 7,387,176 | B2 | 6/2008 | Mellott | |
| 7,665,549 | B2 | 2/2010 | Lyon | |
| 8,069,926 | B2 * | 12/2011 | Eddison | E21B 34/06 137/496 |
| 8,479,812 | B2 | 7/2013 | Zupanich | |
| 8,607,896 | B2 | 12/2013 | Kolle et al. | |
| 2003/0230430 | A1 | 12/2003 | Martini | |
| 2005/0211471 | A1 * | 9/2005 | Zupanick | E21B 21/103 175/57 |
| 2008/0011517 | A1 | 1/2008 | Lyon | |
| 2010/0032209 | A1 | 2/2010 | Rainey et al. | |
| 2010/0282476 | A1 | 11/2010 | Tessier et al. | |
| 2011/0162891 | A1 | 7/2011 | Camp | |
| 2013/0319764 | A1 | 12/2013 | Schaaf et al. | |
| 2015/0218938 | A1 * | 8/2015 | Weisbeck | E21B 21/16 73/152.46 |
| 2016/0010449 | A1 | 1/2016 | Liu et al. | |

FOREIGN PATENT DOCUMENTS

| | | | | |
|---|---|---|---|---|
| CN | 201635666 | U | 11/2010 | |
| CN | 102108839 | A | 6/2011 | |
| EP | 0851090 | A | 7/1998 | |
| EP | 1577128 | * | 9/2005 | B60G 21/055 |

* cited by examiner

OFF BOTTOM FLOW DIVERTER SUB

FIELD OF THE INVENTION

The invention relates to structures for controlling flow of drilling fluid through a drilling assembly, a drilling assembly including the flow controlling structure and a method for drilling.

BACKGROUND OF THE INVENTION

A modern earth boring drilling assembly typically includes a drill string with a drill bit at the base. As the drill bit advances though the earth, material being cut by the bit needs to be removed. A drilling fluid supplied through the drill string travels through the drill bit and across its face to flush material away from the face of the drill bit, into the annular passage between the drill string and the wall of the hole toward the opening of the hole. The drill fluid may be gas, such as air, or liquid, such as drilling mud.

If gas is utilized as the drilling fluid, the gas may be utilized in a positive displacement motor (PDM) to impart rotation on the drill bit at the bottom of the hole. Because gas is compressible, rotation speed of the PDM may vary in response to torque, even with a constant gas flow rate through the PDM. As drilling is carried out, pressure is imparted to the drill bit through the drill string. This may lead to situations in which the bit, whether a hammer, fixed cutter, or roller cone bit, may spin faster when the drilling pressure is removed during a pause drilling. This has may cause whipping contact with the wall of the borehole, potentially damaging the bit and/or the PDM.

The rapid spinning is caused by increased air flow through the down-the-hole (DTH) hammer when it is lifted off the bottom of the hole as opposed to during drilling. Along these lines, when a DTH hammer is lifted off the bottom of the hole, the bit is allowed to drop about 1-2" out of the hammer. This shifts ports inside the tool into a separate mode of operation, in which the impact cycle stops and air that would otherwise move the piston exits directly through the hammer. This path is much less restrictive than the path during drilling. As a result, pressure inside the drill string rushes through the hammer when the string is lifted, resulting in a sudden increase in rotation speed.

Another purpose of drilling fluid is to help prevent influx of fluid from the formation being drilled into the hole. To address this situation, air utilized at the drilling is replaced by fluid, such as drilling mud, as the circulating fluid to stop the influx of fluids from the formation being drilled. This practice typically involves supplying high fluid flow rates to the drill string to establish an annular fluid column of sufficient weight to overcome the pressure of formation fluids. This necessitates opening of alternative flow passages between the drill string and annulus.

Flow of drilling fluid may create damaging or suboptimal drilling conditions in other circumstances when utilizing a PDM as well as with utilizing other types of drilling equipment. For example, in certain situations with rotary or DTH blasthole drilling, the flow capacity of the air compressor supplying drilling air is greater than can be supplied at a minimum required pressure at the hammer or bit to support the drilling process. In such situations, when the compressor reaches a maximum rated pressure, the compressor throttles back flow output. As a result, the compressor produces less than a potential flow due to the restriction introduced by the hammer or bit.

Additionally, fixed-orifice drill string flow elements including a series of holes arranged at an upward angle in the annulus between the hole and the drill string may be utilized to help create a flow out of the hole to remove cuttings and debris. Utilizing such flow elements may result in a vacuum effect below the device, scavenging flow away from the drilling face of the bit. This effect has been shown to be so powerful that it may accelerate abrasive wear on external surfaces of hammers and bits.

Typically, alternate flow passages are provided utilizing pump-out sub-assemblies, or subs, that may utilize extremely high pressure or external impacts (shear pin) to open the secondary passage to annulus. If extremely high pressure is utilized, a rupture disc may be utilized. The rupture disc is designed to provide a leak-tight seal within a pipe or vessel until the internal pressure rises to a predetermined level. At that point the rupture disc bursts preventing damage to the equipment from overpressure. The shear pin will break if the rotation becomes too great. However, once employed the rupture disc and shear pin must be replaced before providing the functionality again.

There is currently no system on the market to actively vary flow between on and off bottom conditions. Currently available pump-out subs require either extreme fluid pressures or introduction of a steel bar to the drill string. This not only complicates operation, but makes a response to rapid formation fluid influx time consuming.

SUMMARY OF THE INVENTION

Embodiments include an off bottom flow diverter subassembly. A fronthead includes a central bore. A shank includes a central bore. One of the shank and the fronthead has an outer diameter configured to fit within the central bore of another of the fronthead and the shank such that the shank and fronthead are arranged to slide longitudinally with respect to each other. The fronthead and the shank are limited from sliding out of contact with each other. At least one diverting flow passage is between adjacent sliding surfaces of the shank and the fronthead. Sliding of the fronthead and the shank with respect to each other opens and closes the at least one diverting flow passage. Application of a force, sufficient to open the at least one diverting flow passage, to a drill string to which the off bottom flow diverter subassembly is attached in a direction toward an opening of a hole being drilled causes the at least one diverting flow passage to open and flow of drilling fluid out of the off bottom flow diverter subassembly and away from the bit.

Additionally, embodiments include a drilling assembly including a drill string and an off-bottom flow diverter subassembly operatively connected to the drill string. The off-bottom flow diverter subassembly includes a fronthead including a central bore. A shank includes a central bore. One of the shank and the fronthead has an outer diameter configured to fit within the central bore of another of the fronthead and the shank such that the shank and fronthead are arranged to slide longitudinally with respect to each other. The fronthead and the shank are limited from sliding out of contact with each other. At least one diverting flow passage is between adjacent sliding surfaces of the shank and the fronthead. Sliding of the fronthead and the shank with respect to each other opens and closes the at least one diverting flow passage. A bottom hole assembly is arranged downstream of the off-bottom flow diverter subassembly. Application of a drilling force to the drill assembly causes the at least one flow passage to close. Application of a force, sufficient to open the at least one diverting flow passage, to the drill assembly in a direction toward an opening of a hole being drilled causes the at least one diverting flow passage to open and flow of drilling fluid out of the off bottom flow diverter subassembly and away from the bit.

Furthermore, embodiments include a method for drilling. One of a shank having a central bore and a fronthead having a central bore is inserted into another of the fronthead and the shank such that the shank and the fronthead are arranged to slide longitudinally with respect to each other. A drill string is attached to the shank. A drilling pressure is applied to the drill string, thereby causing at least one diverting flow passage between the shank and the fronthead to close. Drilling fluid is passed through a bottom hole assembly including the shank and the fronthead. A force is applied to the drill string in a direction toward an opening of a hole being drilled, thereby causing the shank and the fronthead to slide relative to each other to an extent sufficient to open the at least one diverting flow passage, thereby permitting flow of drilling fluid through the at least one diverting flow passage out of the off bottom flow diverter subassembly and away from a bit to which the drill string is attached.

Still other objects and advantages of the present invention will become readily apparent by those skilled in the art from the following detailed description, wherein is shown and described only the preferred embodiments of the invention, simply by way of illustration of the best mode contemplated of carrying out the invention. As will be realized, the invention is capable of other and different embodiments, and its several details are capable of modifications in various obvious respects, without departing from the invention. Accordingly, the drawings and description are to be regarded as illustrative in nature and not as restrictive.

BRIEF DESCRIPTION OF THE DRAWINGS

The above-mentioned objects and advantages of the present invention will be more clearly understood when considered in conjunction with the accompanying drawings, in which.

DETAILED DESCRIPTION OF EMBODIMENTS OF THE INVENTION

Figure 1:
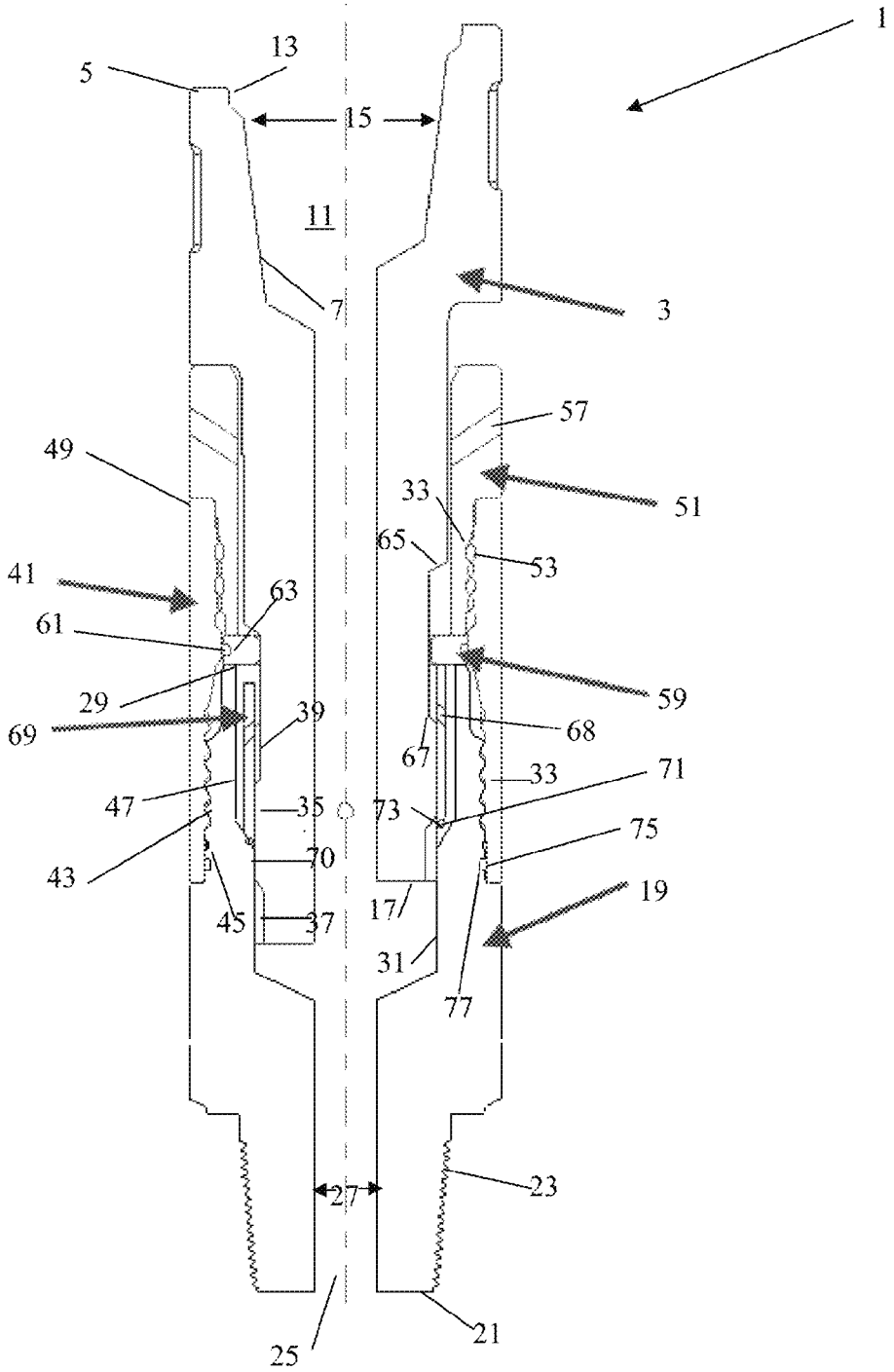
FIG. 1 represents a cross-sectional view of an embodiment of an off-bottom flow diverter subassembly.

Equipment for earth drilling and, hence, drilling operations, is expensive. Although drilling equipment is robust to withstand forces encountered in drilling, it is those forces that wear down the equipment. In certain circumstances, drilling equipment may be acutely exposed to forces that exceed designed physical limitations of the drilling equipment. Any time a drilling rig is not operational reduces the productive use of the drill rig. Additionally, repair, replacement and maintenance not only require time and money to carry out. A structure that can reduce or eliminate situations leading to damage to drilling equipment would save time and money and increase operational time and productivity of drilling equipment. It would be desirable to have a structure to decrease or prevent the possibility of continued fluid pressure on a PDM and drill bit in the event of the reduction or elimination of overload as well as the other problems discussed above.

As referred to above, normal operating procedures can result in damage to drilling equipment. Embodiments of the invention provide an automatically adjusting structure that can avoid damage to positive displacement motors and other equipment. Along these lines, embodiments of the invention greatly reduce or eliminate flow of drilling fluid to a positive displacement motor or other structures located downstream of the automatically adjusting structure. As such, the automatically adjusting structure can divert flow of drilling fluid so that the drilling fluid does not reach the positive displacement motor or other structure.

In general, embodiments of the invention can provide one or move valves that open when drilling pressure is eliminated or reversed. In other words, as force is applied to move a drill string and attached equipment out of a hole, the valve(s) open so as to divert flow of drilling fluid out of the drill string. As a result, flow of the drilling fluid toward the bottom hole assembly is greatly reduced or eliminated. Typically, the fluid enters a space between the drill string and the wall of the hole being drilled. When drilling pressure is applied, the valve(s) close, so drilling fluid is no longer diverted out of the drill string. As a result, embodiments of the invention may prevent flow through the valve(s) during drilling. As such, embodiments of the invention provide a simple solution that may be retrofitted into existing drilling equipment. Embodiments of the claimed invention do not require complicated structures that include springs or other structures.

The off bottom flow diverter sub assembly may drop out in a manner similar to a DTH hammer bit, diverting air flow away from the PDM and DTH hammer under similar conditions. A benefit of embodiments of the off bottom flow diverter sub assembly is that they may provide a feedback loop that may indicate to a driller when bottom is tagged through an increase in pressure at the standpipe. Embodiments of the off bottom flow diverter sub assembly may be utilized with any bit.

Figure 2:
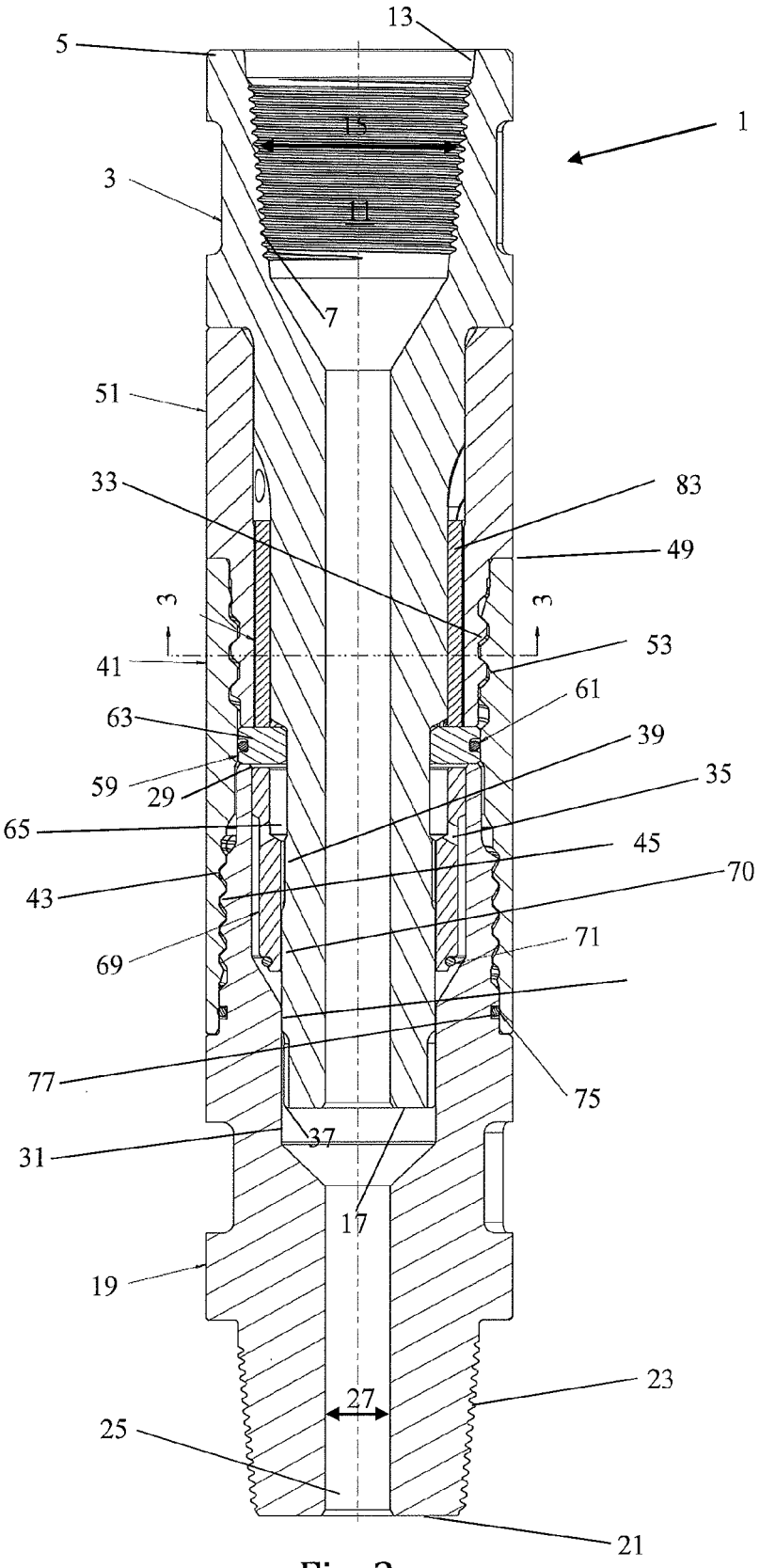
FIG. 2 represents a cross-sectional view of another embodiment of an off-bottom flow diverter subassembly.
Figure 11:
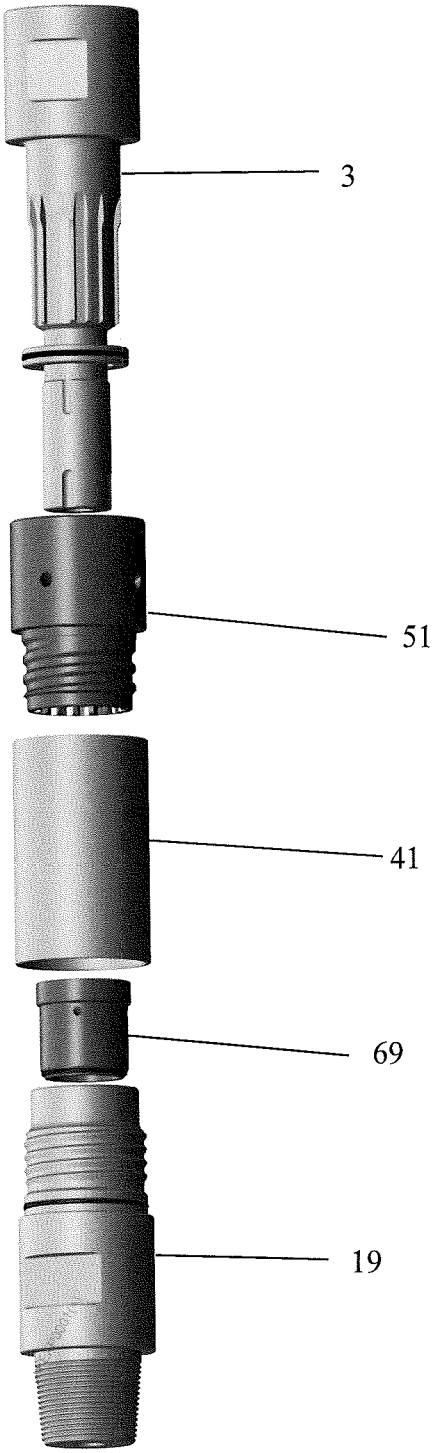
FIG. 11 represents an exploded perspective view of the embodiment of the embodiment of the off-bottom flow diverter subassembly shown in FIG. 2.

FIGS. 1 and 2 illustrate two embodiments of an off-bottom flow diverter subassembly. FIG. 11 represents an exploded view of the embodiment shown in FIG. 2. The sub-assembly may be installed at any location in a drill string above a bottom hole assembly. Typically, the off-bottom diverter sub may be installed anywhere in the BHA behind the PDM. More typically, the off-bottom diverter sub may be installed immediately behind the PDM. While only one off-bottom diverter sub is typically utilized, it is possible that more than one may be included in a drilling assembly. Factors that may control where the off-bottom diverter sub is arranged may include length of the drill string, pressure of drilling fluid being utilized and fluid pressure from a material into which is being drilled.

FIG. 1 illustrates the embodiment of the off-bottom diverter sub in a drilling, or compression, state on the left and in a flushing, or tension, state on the right. The embodiments of the off-bottom diverter 1 sub shown in FIGS. 1 and 2 include a shank 3. A first end 5 of the shank typically includes a threaded connection 7 configured to be connected to a corresponding threaded connection on the drill string, not shown in FIGS. 1 and 2. The threaded connection 7 may be male or female, depending upon the connection on the drill string to which the off-bottom diverter sub is attached.

Typically, the first end 5 of the shank 3 has an outer diameter substantially the same or the same as an outer diameter of the drill string to which the shank is attached. The shank 3 has an inner passage or central bore 11 extending therethrough. At the opening 13 of the inner passage 11, its diameter 15 is substantially the same or the same as the inner diameter of the drill string to which it is attached. The inner diameter 15 may vary, depending upon whether the threaded connection is male or female. The inner diameter 15 of the inner passage of the shank 3 and the outer diameter of the shank may narrow in regions where the shank engages other elements of the off-bottom diverter sub 1.

Figure 3:
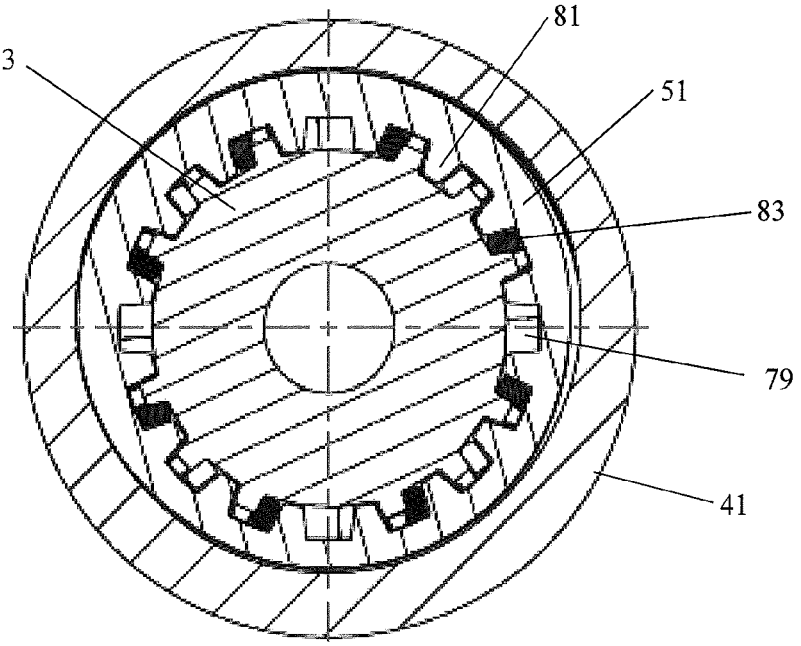
FIG. 3 represents a cross-sectional view of the embodiment shown in FIG. 2 along the 3-3.
Figure 4:
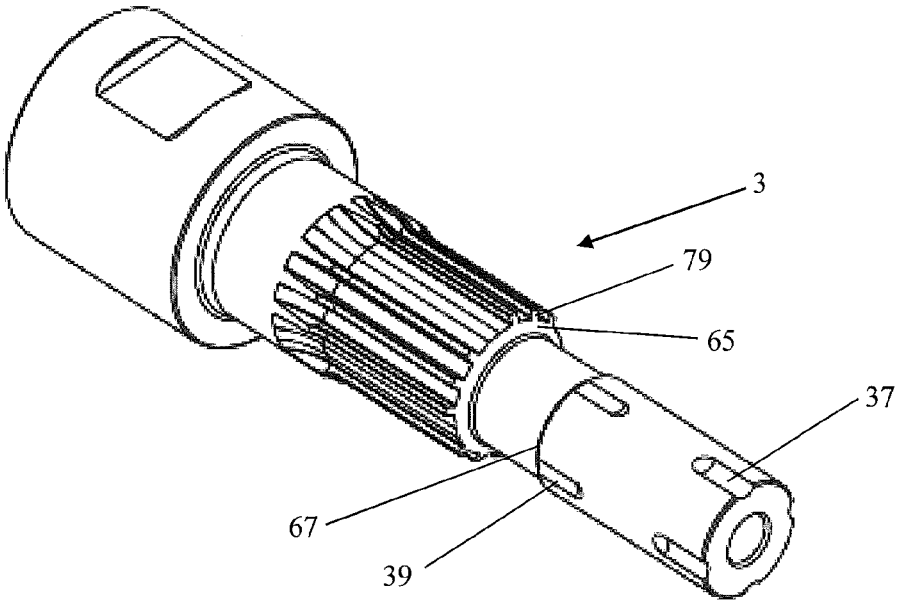
FIG. 4 represents a perspective view of the embodiment of the shank shown in FIG. 2.
Figure 10:
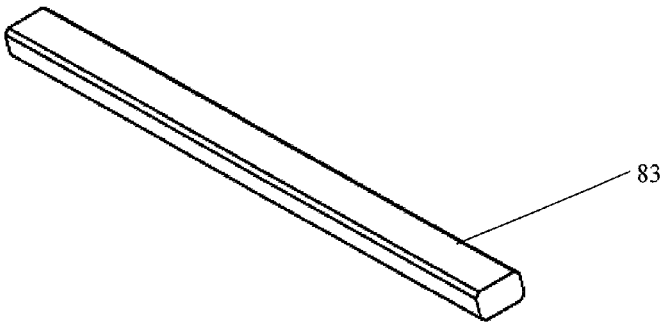
FIG. 10 represents a perspective view of the embodiment of the drive pin shown in FIG. 2.

FIG. 4 illustrates a perspective view of an embodiment of a shank shown in FIG. 2. The embodiment of the shank shown in FIG. 4 includes a plurality of splines 79 about a portion of its outer surface. The splines 79 engage complementary splines 81 on a chuck 51 described below in greater detail. The splines transmit rotary motion through the off-bottom flow diverter sub-assembly and help to guide the shank as it slides relative to other elements of the sub-assembly. Drive pins 83 are arranged in some of the spaces between splines on the shank and splines on the chuck. FIG. 10 illustrates a perspective view of the embodiment of the drive pin shown in FIGS. 2-5. FIG. 3 shows a cross-sectional view of the embodiment shown in FIG. 2 along the line 3-3.

Figure 9:
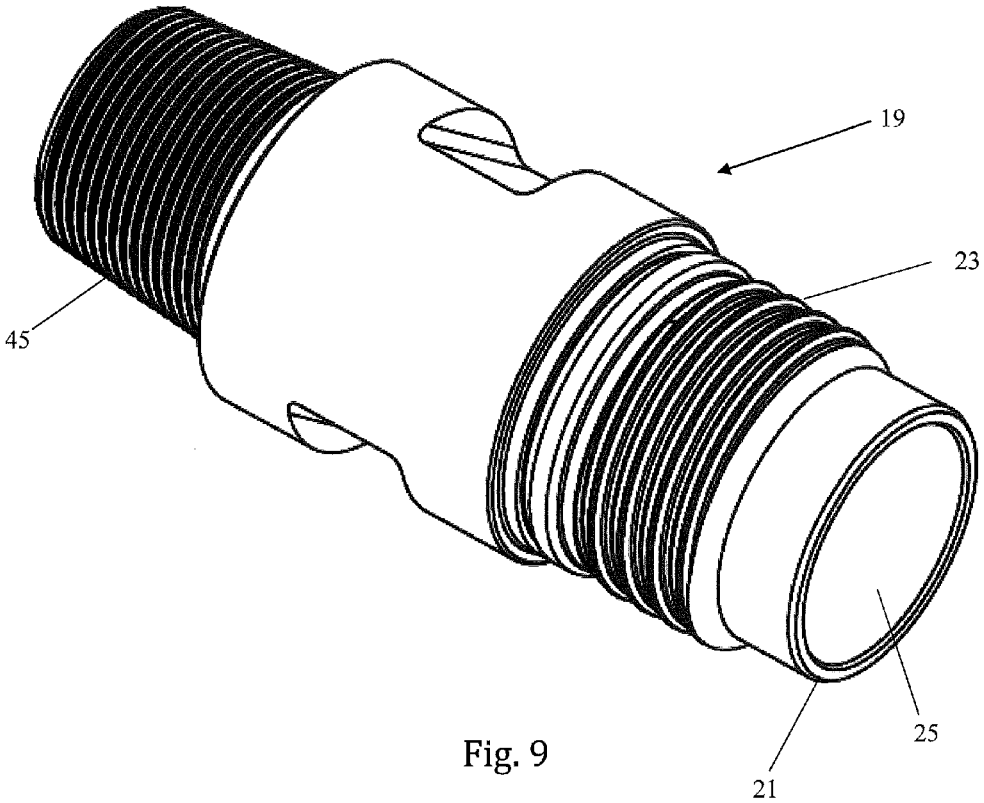
FIG. 9 represents a perspective view of the embodiment of the backhead shown in FIG. 2.

The embodiment of the off-bottom diverter sub 1 shown in FIGS. 1 and 2 also includes a fronthead 19. A first end 21 of the fronthead 19 may include a threaded connection 23 configured to engage a complementary threaded connection on a portion of the drill string in which the off-bottom diverter sub 1 is incorporated. The threaded connection 23 may be male or female, depending upon the threaded connection on the drill sting to which the off-bottom diverter sub 1 is attached. FIG. 9 provides a perspective view of the embodiment of the fronthead shown in FIG. 2.

The fronthead 19 has in inner passage or central bore 25 extending first end 21 of the fronthead 19 is attached. The inner passage has a diameter 27 having a diameter that may vary depending upon whether the threaded connection 23 on the fronthead 19 is male or female. Toward a second end 29 of the fronthead 19, the inner passage 25 of the fronthead 19 may have an increased diameter. The diameter of the fronthead 19 between the first end 21 and second end 29 may receive the second end 17 of the shank 3. Alternatively, the end of the fronthead 19 may be received in the inner passage of the shank 3.

The inner passages of the shank 3 and the fronthead 19 may be shaped to as to provide the valve to control flow of drilling fluid. For example, according to the embodiments shown in FIGS. 1 and 2, the inner passage of the fronthead 19 and the outer surface of the shank 3 have different regions that have different diameters. Along these lines, the inner passage of the fronthead 19 includes a first region 31 that has a diameter that is just large enough to permit the shank to be inserted into the fronthead 19.

The diameter 27 of the inner passage 25 of the fronthead 19 includes at least one other region 33 that forms part of the valve and passage that permits diversion of drilling fluid out of the off-bottom diverter sub 1. The diameter of the region 33 is greater than the diameter of the region 31. The diameter of the region 33 may vary, depending upon a desired flow of drilling fluid. Along these lines, the diameter of the region 33 may be greater if a greater flow volume is desired.

The region 33 may extend continuously around the entire inner passage. Alternatively, the region 33 may extend around less than the entire inner passage. Additionally, the inner passage 25 may include a plurality of regions 33 that extend around the inner passage.

Similar to the inner passage 25 of the fronthead 19, the outer surface of the shank 3 may have regions of different diameters to permit the structures of shank 3 and fronthead 19 to cooperate and form the valve. Along these lines, the shank 3 may include a region 35 having an outer diameter just small enough to permit the shank 3 to be inserted into the inner diameter region 31 of the fronthead 19. At least below the region 35 of the shank is a second region 37 of the outer surface having a diameter less than the region 35. Additionally, the shank 3 may include a third region 39 having reduced outer diameter. The region 39 having a reduced diameter may form part of the flow path In operation, as the shank 3 slides within the fronthead 19, the various regions of the two structures having different diameters interact to open and close the valve as described in greater detail below. The outer diameter and inner diameter of the shank 3 and fronthead 19 may also engage other structures of the off-bottom diverter sub 1. The other structures may form part of the valve, thereby controlling flow of drilling fluid and connect various elements of the off-bottom diverter sub 1.

Figure 6:
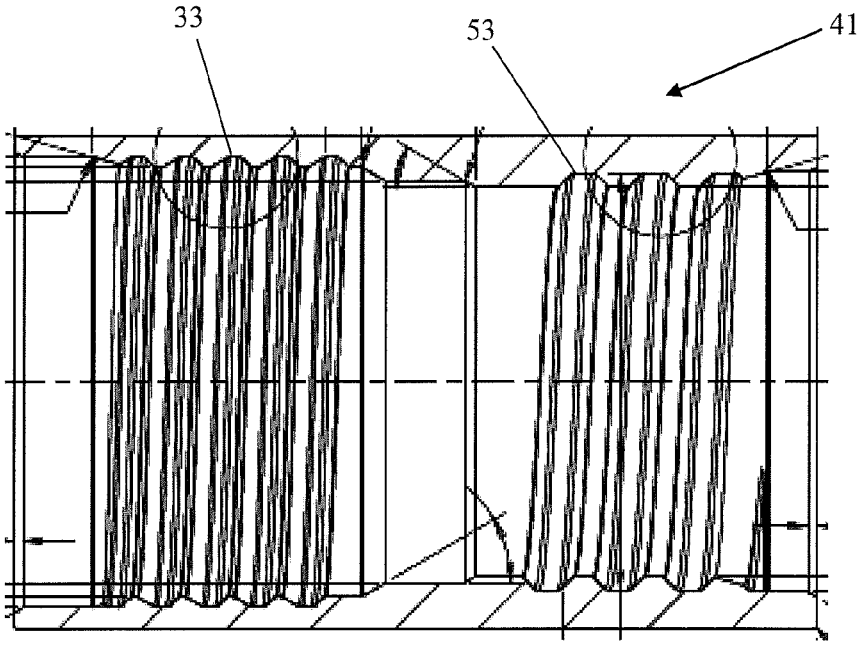
FIG. 6 represents a cross-sectional view of the embodiment of the casing shown in FIG. 2.

In addition to the shank 3 and fronthead 19, the embodiment of the off-bottom diverter sub 1 shown in FIG. 1 may include a casing 41. The casing 41 may be connected to the fronthead 19 by threaded connections 43 and 45 included on a lower end 47 the casing 41 and fronthead 19, respectively. FIG. 6 provides a cross-sectional view of the embodiment of the casing shown in FIG. 2.

Figure 5:
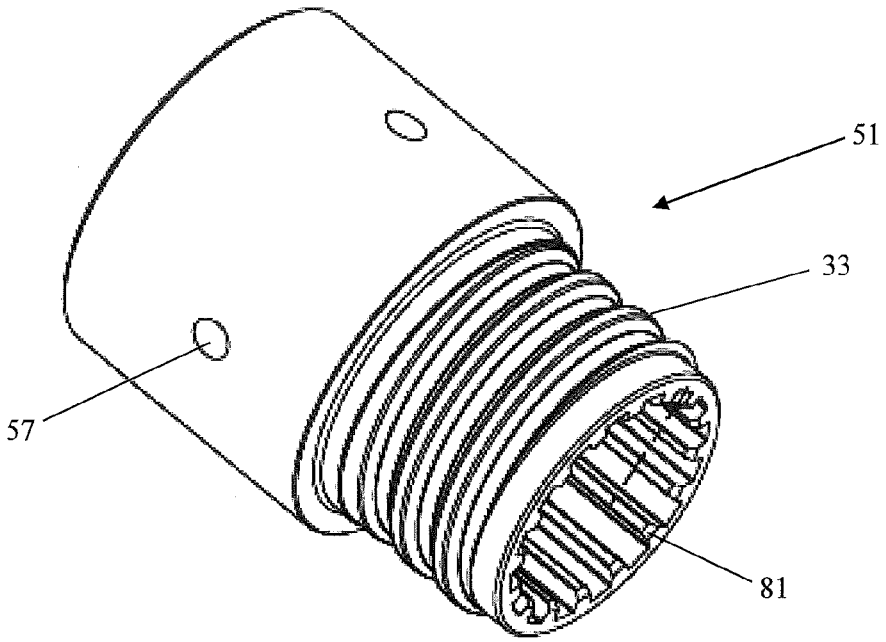
FIG. 5 represents a perspective view of the embodiment of the chuck shown in FIG. 2.

An upper end 49 of the casing 41 may be configured to receive a chuck 51. The casing 41 and chuck 41 include a threaded connections 53 and 55, respectively, configured to connect the casing 41 and the chuck 51. Both the casing 41 and the chuck 51 typically have maximum outer diameters that are the same as the fronthead and shank and drill string. An O-ring 75 may be arranged between the casing and the fronthead to seal the space therebetween. The casing and/or the fronthead may include a notch 77 configured to receive at least a portion of the O-ring. The chuck may include at least one outlet 57 through which drilling fluid may flow when the off-bottom diverter sub 1 is in tension, as discussed below. FIG. 5 provides a perspective view of the embodiments of the chuck shown in FIG. 2.

To control movement of the shank 3 relative to the fronthead 19, at least one retaining ring 59 may be arranged between the casing 41 and the shank 3. The at least one retaining ring 59 typically is sandwiched in the subassembly between the shank 3 and the fronthead 19. The retaining ring 59 shown in FIGS. 1, 2 and 7 includes a notch 63 about its outer diameter. The notch 63 accommodates an O-ring seal 61 to seal the space between the outer diameter of the retaining ring 59 and the inner surface of the casing 41. The embodiments shown in FIGS. 1 and 2 include one retaining ring 59.

Figure 7:
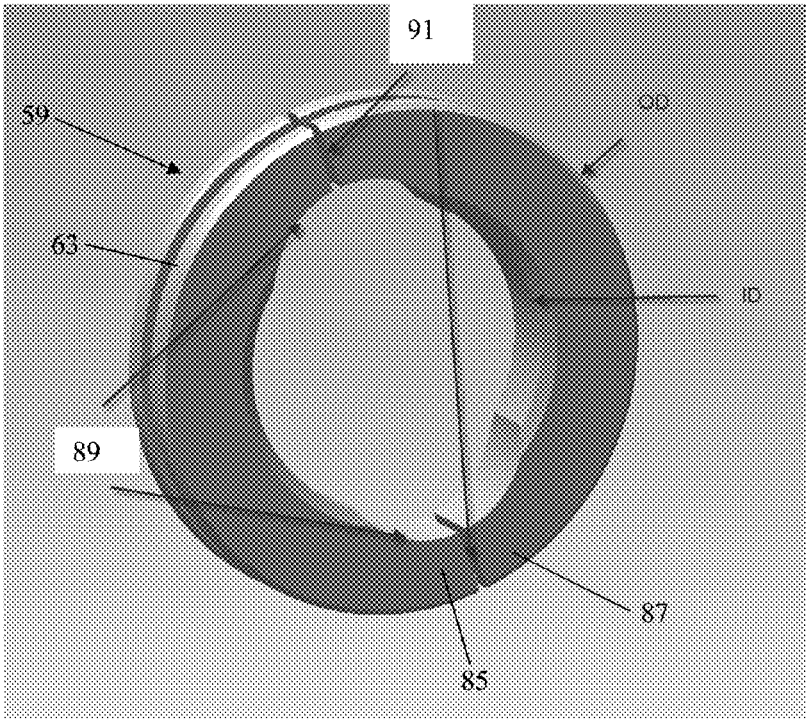
FIG. 7 represents a perspective view of the embodiment of the retaining ring in FIG. 2.

The embodiment of the retaining ring 59 shown in FIG. 7, which is included in the embodiment of the subassembly shown in FIG. 2, includes a single disc that is split into two pieces 85 and 87. The outer diameter OD of the ring matches the inner diameter ID of the casing. This prevent the parts of the retaining ring from expanding outward.

On the other hand, the parts of the retaining ring 59 may be prevented from collapsing inward by fitment of the two halves 85 and 87 together. The two halves 85 and 87 of the retaining ring 59 are sandwiched axially between the fronthead 19 and the chuck 51. The fronthead 19 and the chuck 51 are threaded into either end of the casing 41. The retaining ring 59 assembly has an inner diameter that is smaller than the outer diameter of the shank 3. The interference between the inner diameter of the retaining ring 59 and the outer diameter of the shank 3 prevents the shank 3 from completely sliding out of the assembly.

The retaining ring 59 typically includes at least one scallop 89 in its inner diameter that permits fluid to flow past the ring. The scallops 89 may be arranged anywhere about the inner diameter of the retaining ring 59. In the embodiment of the retaining ring 59 shown in FIGS. 2 and 6, the scallops 89 are arranged in the vicinity of the splits 91 between the two halves 85 and 87 of the retaining ring 59. However, the scallops 89 may be arranged elsewhere about the inner diameter of the retaining ring 59. If the scallops 89 are not arranged to meet as in the embodiment shown in FIG. 6, then the scallops 89 on each ring part 85 and 87 typically are larger to provide a similar flow volume.

The retaining ring 59 controls the movement of the shank 3 and fronthead 19 relative to each other by engaging the chuck 51 and fronthead 19. A space between the outer surface of the shank 3 and the inner surface of the casing 41 provides a passage for flow of drilling fluid during flushing, when the off-bottom diverter sub 1 is in tension. The function of the valve is discussed below.

Figure 8:
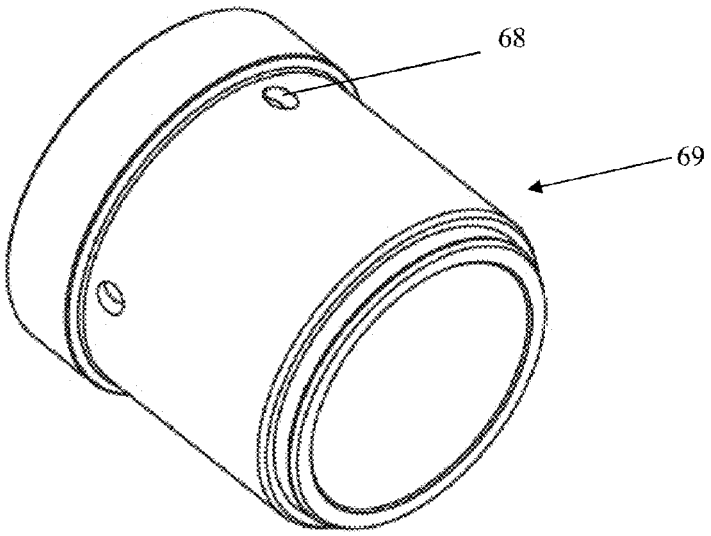
FIG. 8 represents a perspective view of the embodiment of the check valve shown in FIG. 2.

To further control flow of flushing fluid, the off-bottom diverter sub 1 may include a check valve 69. FIGS. 1 and 2 illustrate an embodiment of the check valve 69 incorporated into the embodiments of the subassembly shown therein. FIG. 8 illustrates a perspective view of the embodiment of the check valve 69 shown in FIG. 2. The check valve 69 may be arranged in the space defined by the retaining ring(s), interior surface of the fronthead 19, exterior surface of the casing 3 and the lower flange formed by the change in diameter of the interior surface of the fronthead 19. When drilling fluid is flowing through the off bottom flow diverter subassembly, the drilling fluid will flow up through the space between the fronthead 19 and the check valve 69 and exit the check valve through ports 68, flowing into volume 67 between the check valve and the shank, up through the scallops in the retaining ring, into volume 65, through spaces between the splines on the shank and chuck and the drive pins, and out through exhaust passages 57 in the chuck.

The check valve 69 operates to reduce or eliminate back flow from the hole into the off-bottom diverter sub 1. The back flow can result any time there is a greater fluid pressure outside the off-bottom diverter sub 1 than within the structure. An O-ring 71 may be arranged in a notch 73 at the base of the check valve 69. As described below, the check valve 69 and O-ring 71 may help to prevent flow into the off-bottom diverter subassembly from the annular space between the off-bottom diverter subassembly and the wall of the hole being drilled.

The off-bottom diverter sub 1 can be inserted into a drill string above the bottom hole assembly (BHA). As described below, the off-bottom diverter sub 1 seals to provide full flow of drilling fluid to the BHA when the BHA is under net compressive load, during drilling, and diverts a quantity of flow of drilling fluid directly to the annulus between the off-bottom diverter sub 1 and drill string when the BHA is under a net tensile load, as it is lifted off-bottom. Diverting flow of drilling fluid away from the BHA reduces the rotation speed of the PDM when lifted off bottom, thereby allowing continuation of full flow through the annulus when off bottom. This may improve the ability to flush cuttings from the hole while reducing the chances of damaging the bit against the borehole wall.

During drilling, when the valve is closed, the entire flow of drilling fluid is channeled through the BHA, providing full torque and rotation speed during drilling. The orientation of the elements of the off-bottom diverter sub 1 during drilling is shown in the left-hand side of FIG. 1. In this configuration, a drilling force is being applied from the top of the structure toward the bottom. As shown in FIG. 1, the outer surface of the shank 3 and the inner surface of the fronthead 19 are flush against each other in the region 70. Also, the region 37 of the outer surface of the shank 3 having a reduced diameter is moved away from the region 33 of the interior surface of the fronthead 19 having an increased diameter. These movements close the valve and prevent the flow of drilling fluid through the valve and into the annulus between the hole wall and the drill string and off-bottom diverter sub 1.

Figure 12:
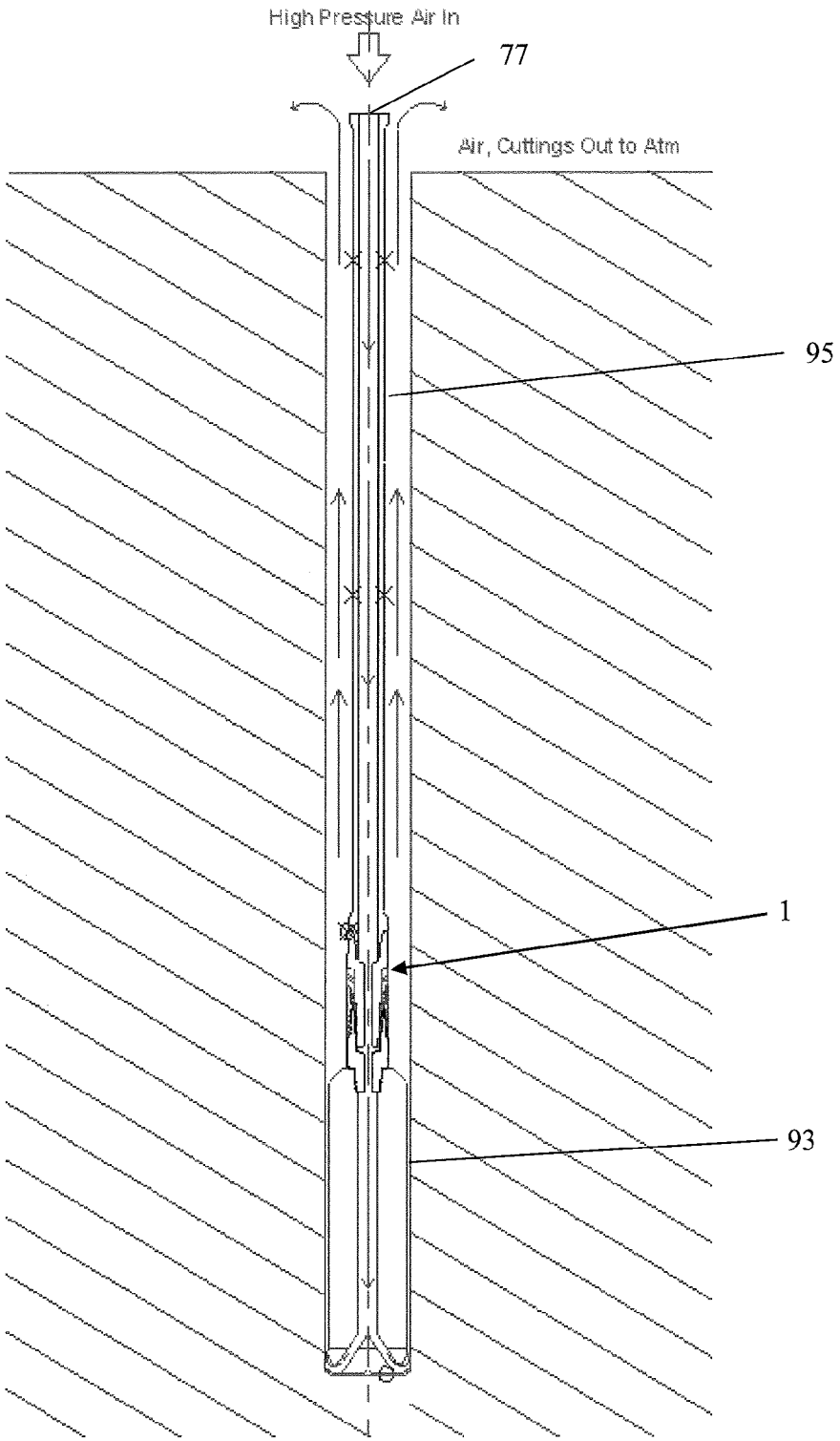
FIG. 12 represents a cross-sectional view of a drill string including the embodiment of the off-bottom flow diverter subassembly shown in FIG. 1 in a drilling mode.

FIG. 12 illustrates the BHA 93, off-bottom diverter sub 1 and drill string 95 during drilling with the off-bottom diverter sub 1 valve closed. In this state, the BHA contacts the bottom of the hole, downward pressure is applied to the drill string to impart cutting force to apply the drill bit to the formation being drilled. Drilling fluid, in this embodiment, high-pressure air is introduced through the end 77 of the drill string 95. The air flows down the drill string 95 to the drill bit located at the bottom of the hole. The drilling fluid exits the drill bit through flow passages to clear cuttings from the face of the drill bit and bottom of the hole. The drilling fluid with cuttings flows up through the annulus between the drill string and hole wall out of the hole to the atmosphere.

Figure 13:
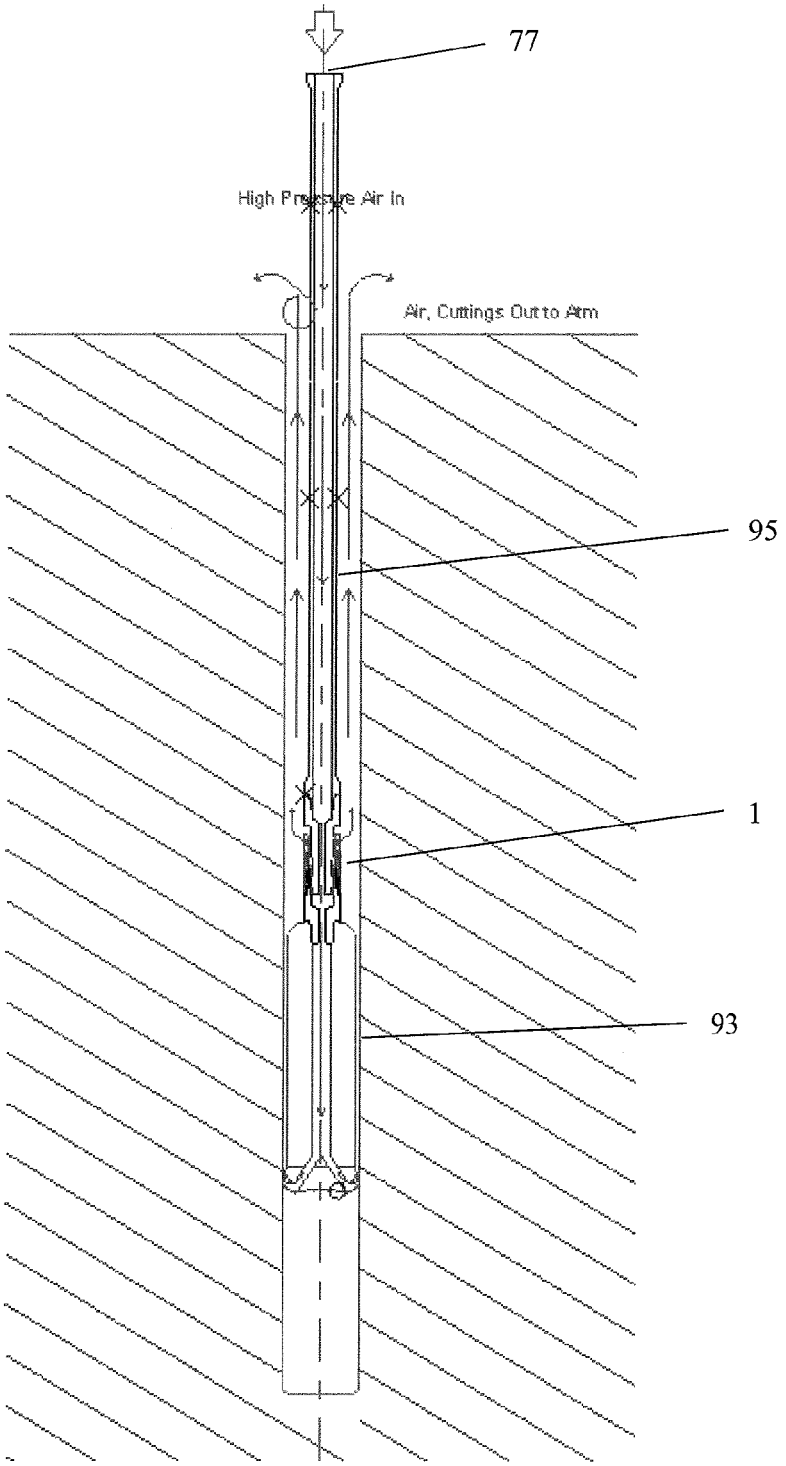
FIG. 13 represents a cross-sectional view of the drill string including the embodiment of the off-bottom flow diverter subassembly shown in FIG. 1 in a flushing mode.
Figure 14:
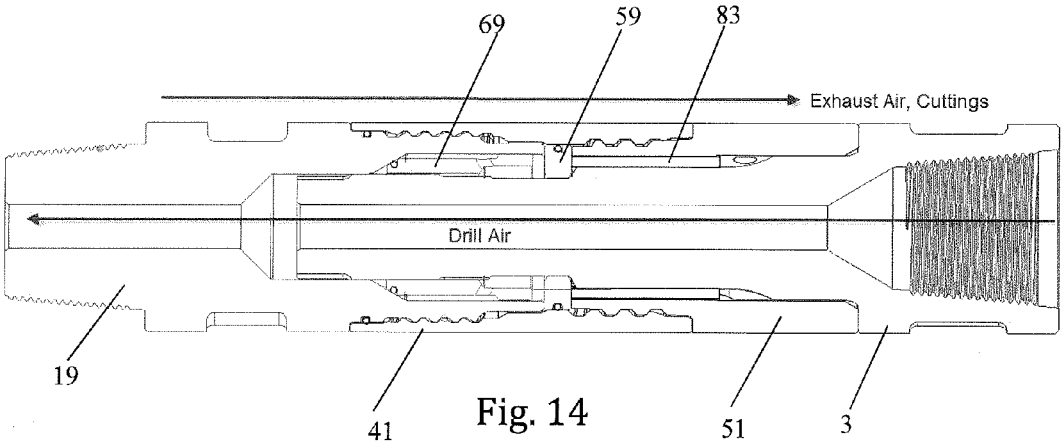
FIG. 14 represents a cross-sectional view of the embodiment of the off-bottom flow diverter subassembly shown in FIG. 2 illustrating flow paths during drilling.

FIG. 14 illustrates a close-up view of the off-bottom flow diverter subassembly during drilling. As shown in FIG. 13, during drilling, the ports that permit drilling fluid to flow through the off-bottom flow diverter subassembly are closed. As a result, the off-bottom flow diverter subassembly acts as a typical piece of pipe, permitting drilling fluid to flow therethrough. The flow paths of drilling fluid, which in this embodiment is air, through the off-bottom flow diverter subassembly and cuttings created by the drilling and exhaust drilling fluid are shown.

When drilling is stopped or paused for any reason, an upward force is applied to the drill string, a drilling force is no longer applied to the drilling components but the drilling fluid continues to flow, leading to the problems described above. FIG. 13 shows the drill string shown in FIG. 12 with the bit lifted up. The off-bottom diverter sub 1 will be in the state shown in the right-hand side of FIG. 1. In this case, the shank has moved upwardly relative to the fronthead so that a flow path opens between the outer surface of the shank and the inner surface of the fronthead. A portion of the drilling fluid may still flow down out of the off-bottom diverter sub 1. The parallel flow paths through the off-bottom diverter sub 1 reduce flow through the BHA, slowing PDM rotation and instead provide a flushing flow of drilling fluid at the location of the off-bottom diverter sub 1, which is above, and typically just above, the BHA.

Figure 15:
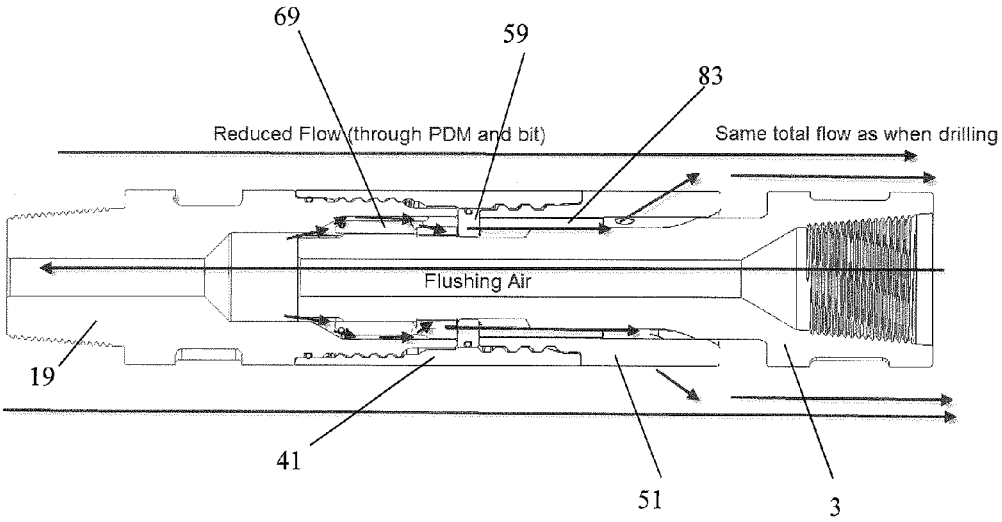
FIG. 15 represents a cross-sectional view of the embodiment of the off-bottom flow diverter subassembly shown in FIG. 2 illustrating flow paths during flushing.

The mass of drilling fluid is constant, whether or not drilling is taking occurring. Diverging at least a portion of the drilling fluid through the off-bottom flow diverter subassembly reduces the mass flow rate through the PDM and bit. Typically, flow is not completely cut off to the PDM and bit. FIG. 15 illustrates flow paths of drilling fluid with the drilling assembly off the bottom of the hole. Typically, the flow is not completely cut off to the PDM and bit.

Figure 16:
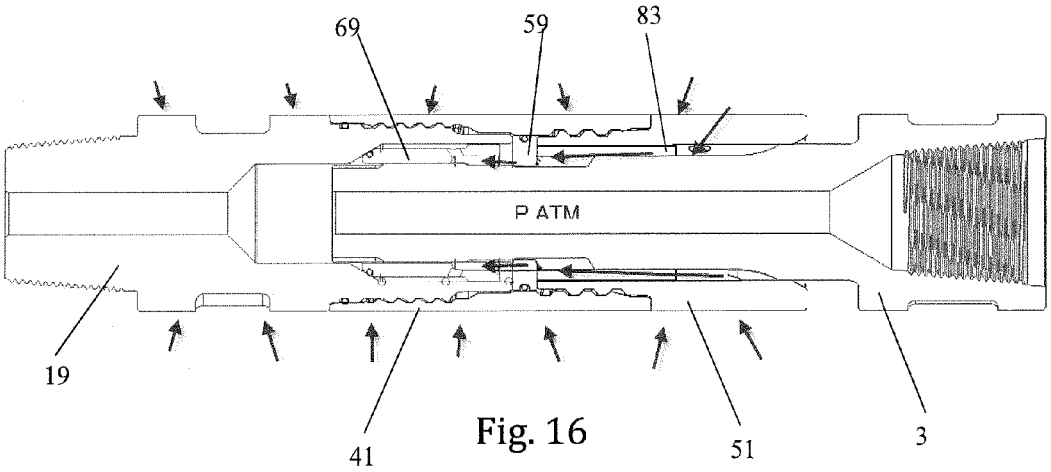
FIG. 16 represents a cross-sectional view of the embodiment of the off-bottom flow diverter subassembly shown in FIG. 2 illustrating pressure from a surrounding formation.

If no drilling fluid is flowing through the off-bottom flow diverter subassembly, such as when the drilling apparatus is off of the bottom of the hole, such as during change of pipe in the drill string, the ports that connect the center bore of the off-bottom flow diverter subassembly and the annulus between the wall of the hole and the off-bottom flow diverter subassembly are open. In such a situation, pressure in the annulus will be greater than atmospheric pressure in the central bore due to influx of fluid from the surrounding formation and annular column and cuttings above the off-bottom flow diverter subassembly. Therefore, the pressure will be greater outside of the sub than within. As a result, the outside pressure is applied through the off-bottom flow diverter subassembly in a direction that is reverse from normal operation, causing flow in a reverse direction from the annulus into the central cavity. This condition is illustrated in FIG. 16.

Figure 17:
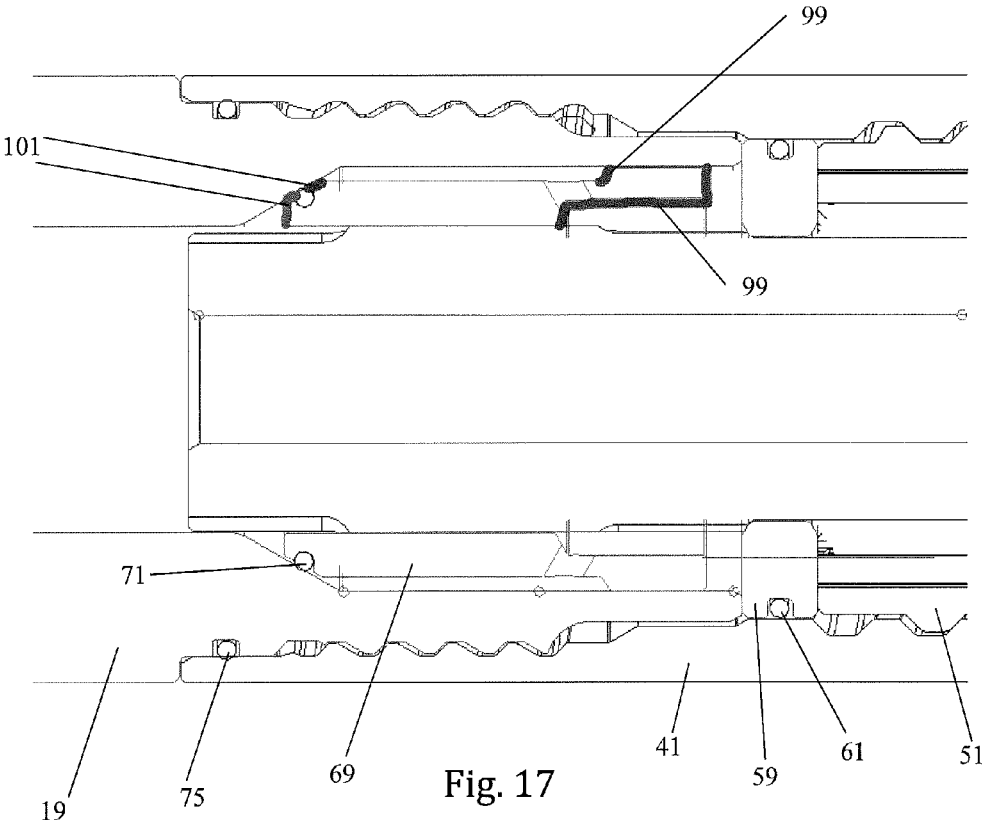
FIG. 17 represents a close-up cross-sectional view of a portion of FIG. 16.

In such a situation, or any time that the pressure in the annulus exceeds the pressure in the central cavity of the off-bottom flow diverter subassembly, the gravity-biased check valve is pushed forward in the subassembly to the closed position. When closed, the check valve O-ring seal may divide the cross sectional area of the check valve into two sections, including exposure to internal pressure and exposure to annular pressure. The area exposed to annular pressure is greater than the area exposed to internal pressure. As a result, the check valve is held closed until the internal pressure is increased above the annular pressure, and typically significantly above. FIG. 17 illustrates a close-up view of pressures within the valve of the off-bottom flow diverter subassembly. In FIG. 17, the area 99 between the central cavity and the O-ring is subjected to atmospheric pressure, while the area 101 between the check valve and the annulus is exposed to a pressure above atmospheric pressure.

The off-bottom diverter sub 1 may also address a sudden influx of formation fluid. Along these lines, the off-bottom diverter sub 1 also serves as a low-resistance flow channel to the annulus between the drill string and wall of the hole for application of drilling fluid. Using the off-bottom flow diverter sub 1, this may be carried out in a manner as simple as lifting the drill string and starting the flow of fluid.

When the off-bottom diverter sub 1 is placed in compression, the shank and fronthead block flow into the passage around the outside of the shank. This requires all flow to pass through the BHA. When in tension, the shank shifts axially inside the assembly and stops against the retaining rings, locating machined scallops on the outside of the shank above the machined edge of the backhead bore, allowing flow to pass. The floating check valve is forced out of the way by flow around the shank, which passes upward through the check valve, retaining rings, through machined scallops, shank/chuck splines, and passageways machined through the chuck. When in tension but without fluid circulation, such as during pipe changes, any pressure in the annulus greater than that inside the drill string will force the check valve closed, preventing entry of annular fluids and contamination of the drill string.

Used in conjunction with a DTH hammer or rotary bit, the off-bottom diverter sub 1 may greatly reduce the risk of damaging drill components when the string is lifted out of contact with the hole bottom while maintaining circulation through the annulus. Additionally, the off-bottom diverter sub 1 may permit hole flushing capacity to be maintained. The check valve helps to prevent contamination from annular influxes.

When suddenly encountering a formation fluid influx, fluid can be supplied to the annulus to control flow as quickly as the string can be lifted off bottom. No extreme pressures are necessary as are required when utilizing a rupture disc sub. Additionally, the off-bottom diverter sub 1 eliminates the need to break a drill string connection to insert a steel rod as required when using a shear pin sub. This decreases response time and simplifies operation.

The off-bottom sub may also compensate for the restriction introduced by a hammer/bit by allowing a reduction in the flow restriction through a drill string, thereby permitting utilization of the full flow potential of a compressor while sweeping.

Additionally, when utilizing fixed-orifice drill string flow elements that include a series of holes arranged at an upward angle in the annulus, such as jet subs, may produce a vacuum effect below the holes, which may scavenge flow away from the drilling face of a bit. This effect has been shown to be so powerful that it accelerates abrasive wear on external surfaces of hammers and bits. The off-bottom sub may be utilized in place of or combined with a jet sub structure to provide the effect only when the drilling assembly is lifted off the bottom of a hole. This can permit selective utilization of advantages of the off-bottom sub when encountering difficulty in cleaning the drilling face of a bit, without suffering detrimental wear effects of scavenging while drilling.

In the context of a DTH, one or more off-bottom sub elements may be utilized to divert air away from a DTH hammer. This will decrease the likelihood that the percussive mechanism will mistakenly operate when lifted off bottom. This is similar to the effect described herein of the off-bottom sub when utilized with a PDM, particularly in directional drilling. In the case of either rotation or percussion, diverting air away from the PDM, hammer or other device saves wear and tear on equipment.

Figure 18:
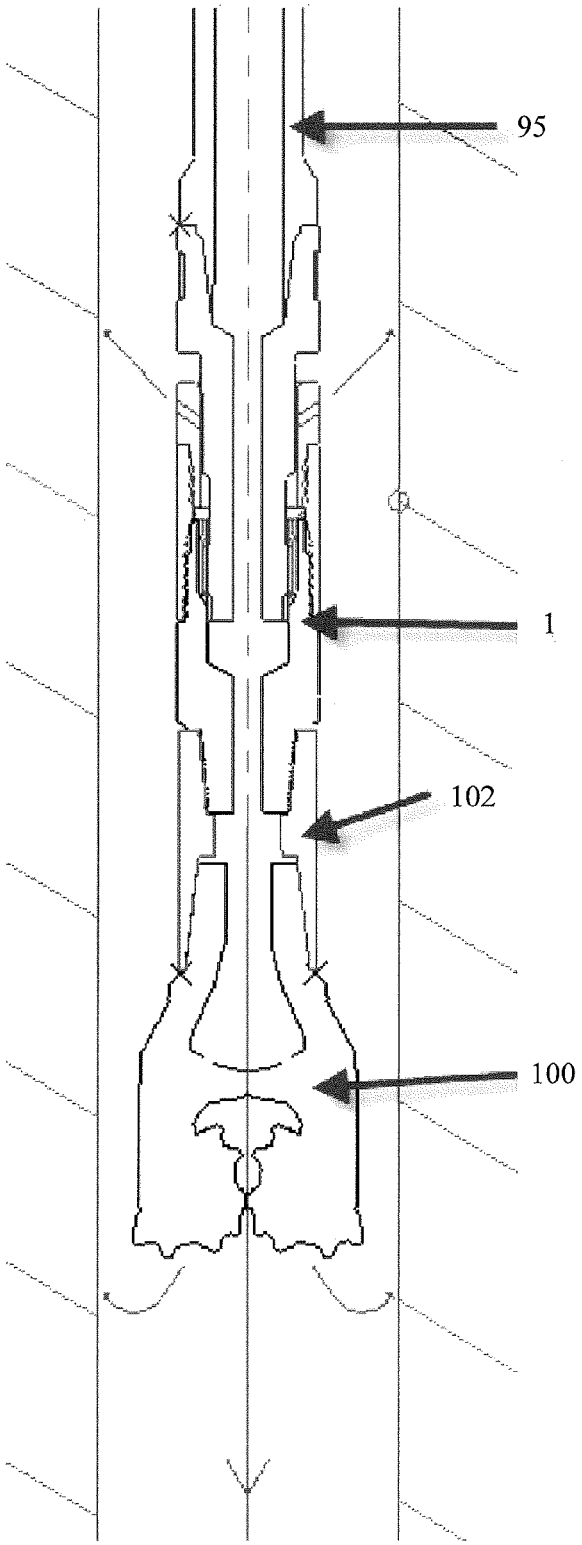
FIG. 18 represents a cross-sectional view of an embodiment of an off-bottom flow diverter subassembly utilized with a tri-cone rotary drill bit.

The off-bottom sub may be utilized with any drilling assembly, such as various bit types. Dimensions, such as outer diameter, threaded connections, and/or other aspect may change. However, the basic structure typically remains the same. FIG. 18 illustrates an embodiment of the off-bottom sub utilized with a tri-cone rotary bit 100. The assembly shown in FIG. 18 includes the off-bottom sub 1, a simple adapter sub 102 and a drill string 95. Such a configuration may be utilized in a blast hole drilling application, for example. When utilizing the off-bottom sub with such a configuration, when drilling all air may flow through the bit for maximum jetting effect at the cutting face. When the assembly is lifted off bottom, as shown in FIG. 18, the upward-facing exhaust passages in the off-bottom sub may create a scavenging effect that 'sucks' cuttings from the bit by accelerating flow up the annulus.

The foregoing description of the invention illustrates and describes the present invention. Additionally, the disclosure shows and describes only the preferred embodiments of the invention, but as aforementioned, it is to be understood that the invention is capable of use in various other combinations, modifications, and environments and is capable of changes or modifications within the scope of the inventive concept as expressed herein, commensurate with the above teachings, and/or the skill or knowledge of the relevant art. The embodiments described hereinabove are further intended to explain best modes known of practicing the invention and to enable others skilled in the art to utilize the invention in such, or other, embodiments and with the various modifications required by the particular applications or uses of the invention. Accordingly, the description is not intended to limit the invention to the form disclosed herein. Also, it is intended that the appended claims be construed to include alternative embodiments.

We claim:

1. An off bottom flow diverter subassembly, comprising:

a fronthead comprising a central bore;

a shank comprising a central bore, the shank connected to a drill string, wherein one of the shank and the fronthead has an outer diameter configured to fit within the central bore of another of the fronthead and the shank such that the shank and fronthead are arranged to slide longitudinally with respect to each other, wherein the fronthead and the shank are limited from sliding out of contact with each other; and at least one diverting flow passage between adjacent sliding surfaces of the shank and the fronthead, wherein sliding of the fronthead and the shank with respect to each other opens and closes the at least one diverting flow passage;

wherein application of a drill string force through the drill string and to the shank sufficient to open the at least one diverting flow passage to the drill string to which the off bottom flow diverter subassembly is attached in a direction toward an opening of a hole being drilled causes the at least one diverting flow passage to open and flow of drilling fluid out of the off bottom flow diverter subassembly and away from the bit.

2. The off bottom flow diverter subassembly according to claim 1, further comprising:

a chuck arranged about an upper portion of the shank, the chuck comprising at least one flow opening configured to direct drilling fluid out of the at least one diverting flow passage; and a casing configured to operatively connect the chuck to the fronthead.

3. The off bottom flow diverter subassembly according to claim 2, wherein the at least one diverting flow passage extends along portions of the shank, chuck, and fronthead.

4. The off bottom flow diverter subassembly according to claim 2, wherein a portion of the outer surface of the shank and portions of the inner surface of the fronthead and chuck comprises scallops at least partially defining the at least one diverting flow passage.

5. The off bottom flow diverter subassembly according to claim 2, further comprising:

a retaining structure configured to limit sliding of the fronthead and the shank with respect to each other, wherein the chuck is secured to the fronthead by the casing and the at least one retaining structure is fixed to the chuck.

6. The off bottom flow diverter subassembly according to claim 2, wherein the chuck and casing are a single unitary structure.

7. The off bottom flow diverter subassembly according to claim 1, wherein the shank slides within the fronthead, wherein the at least one diverting flow passage is arrange between adjacent sliding surfaces of at least a portion of an outside surface of the shank and at least a portion of an inside surface of the central bore of the fronthead.

8. The off bottom flow diverter subassembly according to claim 1, further comprising:

a retaining structure configured to limit sliding of the fronthead and the shank with respect to each other.

9. The off bottom flow diverter subassembly according to claim 8, wherein the retaining structure comprises at least one retaining ring arranged between an outside surface of the shank and an inside surface of the central bore of the fronthead.

10. The off bottom flow diverter subassembly according to claim 9, wherein in compression during drilling, an upper flange on the exterior surface of the shank engages the retaining structure, and the shank and the fronthead close entrance to the at least one diverting flow passage.

11. The off bottom flow diverter subassembly according to claim 8, wherein the retaining structure limits movement of the shank and fronthead relative to each other by engaging the outer surface of the shank.

12. The off bottom flow diverter subassembly according to claim 8, wherein in tension during flushing, a lower flange on the exterior surface of the shank engages the retaining structure, and the shank and fronthead are moved into a relative position such that at least one diverting flow passage opens.

13. The off bottom flow diverter subassembly according to claim 8, wherein the retaining structure further comprises:

a retaining ring having an inner diameter and an outer diameter, the outer diameter having a notch for accommodating an o-ring, and the inner diameter having a scallop.

14. The off bottom flow diverter subassembly according to claim 1, further comprising:

a check valve arranged in the at least one diverting flow passage to control flow of drilling fluid within the passage.

15. The off bottom flow diverter subassembly according to claim 14, wherein the check valve is a floating check valve, wherein pressure outside the off bottom flow diverter subassembly that is greater than pressure within the off bottom flow diverter subassembly will cause the check valve to move to a closed position to prevent flow into the off bottom flow diverter subassembly.

16. The off bottom flow diverter subassembly according to claim 1, wherein the force applied to the drill string is sufficient to lift the drill bit out of contact with a drilling surface.

17. A drilling assembly, comprising:

a drill string;

an off-bottom flow diverter subassembly operatively connected to the drill string, the off-bottom flow diverter subassembly comprising a fronthead comprising a central bore, a shank comprising a central bore, the shank connected to the drill string, wherein one of the shank and the fronthead has an outer diameter configured to fit within the central bore of another of the fronthead and the shank such that the shank and fronthead are arranged to slide longitudinally with respect to each other, wherein the fronthead and the shank are limited from sliding out of contact with each other, and at least one diverting flow passage between adjacent sliding surfaces of the shank and the fronthead, wherein sliding of the fronthead and shank with respect to each other opens and closes the at least one diverting flow passage; and a bottom hole assembly arranged downstream of the off-bottom flow diverter subassembly, wherein application of a drilling force through the drill string and to the shank causes the at least one flow passage to close, and wherein application of a force sufficient to open the at least one diverting flow passage to the drill assembly in a direction toward an opening of a hole being drilled causes the at least one diverting flow passage to open and flow of drilling fluid out of the off bottom flow diverter subassembly and away from the bit.

18. A method for drilling, comprising:

inserting one of a shank having a central bore and a fronthead having a central bore into another of the fronthead and the shank such that the shank and fronthead are arranged to slide longitudinally with respect to each other, wherein the fronthead and the shank are limited from sliding out of contact with each other;

attaching a drill string to the shank;

applying a drilling pressure to the drill string, thereby causing at least one diverting flow passage between the shank and the fronthead to close;

passing drilling fluid through a bottom hole assembly including the shank and the fronthead; and applying through the drill string and to the shank, a force in a direction toward an opening of a hole being drilled, thereby causing the shank and the fronthead to slide relative to each other to an extent sufficient to open the at least one diverting flow passage, thereby permitting flow of drilling fluid through the at least one diverting flow passage out of the off bottom flow diverter subassembly and away from a bit to which the drill string is attached.

* * * * *